United States Patent [19]

Hidaka et al.

[11] Patent Number: 4,922,784

[45] Date of Patent: May 8, 1990

[54] DETENT DEVICE FOR A CONTROL LEVER

[75] Inventors: Sachio Hidaka, Kakogawa; Yoshiaki Fujimoto, Himeji; Takao Tani, Kobe, all of Japan

[73] Assignee: Kabushiki Kaisha Kobe Seiko Sho, Kobe, Japan

[21] Appl. No.: 318,003

[22] Filed: Mar. 2, 1989

[30] Foreign Application Priority Data

Mar. 3, 1988 [JP] Japan ..... 63-28561
Nov. 11, 1988 [JP] Japan ..... 63-147954

[51] Int. Cl.[5] ..... G05G 5/06; G08B 21/00
[52] U.S. Cl. ..... 74/527; 340/686
[58] Field of Search ..... 74/527, 52 G; 340/825.69, 825.72, 686, 678, 456, 679

[56] References Cited

U.S. PATENT DOCUMENTS

| | | | |
|---|---|---|---|
| 3,284,910 | 11/1966 | Klasek | 340/686 X |
| 3,414,879 | 12/1968 | Holland | 340/686 X |
| 4,107,492 | 8/1978 | Moon et al. | 340/686 X |
| 4,163,970 | 8/1979 | Allinquant et al. | 340/686 X |
| 4,381,507 | 4/1983 | Parmer | 340/686 X |
| 4,542,373 | 9/1985 | Hillock | 340/686 X |
| 4,558,312 | 12/1985 | Yonemoto et al. | 340/678 X |
| 4,799,048 | 1/1989 | Goshima et al. | 340/686 X |

FOREIGN PATENT DOCUMENTS 3413423 10/1985 Fed. Rep. of Germany ..... 340/686

*Primary Examiner*—Vinh T. Luong
*Attorney, Agent, or Firm*—Oblon, Spivak, McClelland, Maier & Neustadt

[57] ABSTRACT

A detent device for a control lever includes a cam which moves integral with a control lever by operation of the control lever. A piston is mounted such that the state wherein the end thereof comes into sliding contact with the cam, during movement of the cam, a pressure chamber is formed to communicate with a part of the piston opposite the sliding surface. A spring is provided within the pressure chamber to bias the piston toward the cam. The cam is provided with a detent portion in a part of the surface with which the piston contacts the detent portion. The sliding resistance of the end of the piston is greater at the detent position of the control lever, than at the other locations. A detector detects that the end of the piston is positioned at said detent portion. An oil-pressure supply device supplies oil pressure to the pressure chamber on the basis of a detection signal from the detector. The detector includes an electric contact constituted by a piston and a cam.

6 Claims, 5 Drawing Sheets

DETENT DEVICE FOR A CONTROL LEVER

BACKGROUND OF THE INVENTION

1. Field of the Invention

The present invention relates to a detent device for maintaining a control lever at an operating position which issues a command of a winding-up or other to a winch of a crane or the like.

2. Prior Art

As a conventional detent device for a control lever, the device shown in FIG. 6 is well known. The well known example shows the case where the device is applied to a so-called remote control valve in which a pilot reducing valve is actuated by operation of a lever.

In FIG. 6, the reference numeral 1 designates a control lever, and 2 is a cam secured to the control lever 1, these being integrally rotated around a horizontal shaft 3. Push rods 4*a* and 5*a* of pilot reducing valves 4 and 5 come into contact with the bottom surface of the cam 2 so that one of the reducing valves 4 and 5 is actuated by rotation of the cam 2 and a main control valve not shown is switched by the secondary pressure thereof and the winding-up or winding-down operation is carried out.

Both sides 2*a*, 2*a* (hereinafter referred to as cam surfaces) of the cam 2 are provided with detent recesses 6 . . . at two locations corresponding to operating positions (detent positions) on both sides of the lever. A piston case 8 is provided on a housing 7 housing therein the cam 2, the piston case 8 being interiorly provided with a piston 9 and a bias spring 10 for biasing the piston 9 toward the cam surface 2*a*. A ball 11 in elastic contact with the cam surface 2*a* is held on the end of the piston 9, and at the detent position. The ball 11 is engaged with the recess 6 of the cam 2 whereby the cam 2, that is the control lever is held at the detent position against the spring reaction of the reducing valves 4 or 5.

However, in the aforesaid prior art, the ball 11 is always in contact with the cam surface 2*a* with a fixed spring force, and this spring force is relatively great enough to hold the control lever 1 at the detent position overcoming the reaction of the reducing valve. Therefore, there is an unpleasant feeling of resistance during the operation of the lever, and the operating feeling is poor and the lever operation becomes unduly heavy.

In the control lever for controlling a winch for a crane, operating reaction is increased as a load (a lifting load) increases, and therefore, load pressure or the like of an actuator (hydraulic motor) is applied as a lever operating reaction to the control lever 1, as disclosed in Japanese Utility Model Application Laid-Open No. 14199/1980. In this case, according to the prior art, a proportion of load reaction occupied by the entire operating reaction decreases as the result of great operating resistance (hereinafter referred to as detent resistance) caused by the detent device, which gives rise to a problem in that the load reaction is hard to be transmitted to a driver.

SUMMARY OF THE INVENTION

It is therefore an object of the present invention to provide a detent device for a control lever which can exhibit a great retaining force only at a detent position and reduce the detent resistance in portion other than the detent position to improve an operability and in which in case of employing an arrangement wherein operating reaction is increased according to a load, a proportion of load reaction occupied by the entire operating reaction can be increased to positively transmit the load reaction to the driver.

In accordance with the present invention, there is provided a detent device for a control lever comprising a cam which moves integral with a control lever by operation of the control lever, a piston mounted such that the end thereof comes into sliding contact with the cam by movement of said cam, a pressure chamber formed so as to communicate with an end of said piston, opposite the sliding surface, and a spring provided within said pressure chamber to bias said piston toward said cam, wherein said cam is provided with a detent portion in a part of the surface with which the end of said piston sliding contacts said detent portion and wherein the sliding resistance with the end of the piston is greater at the detent position of the control lever, than elsewhere detection means are provided for detecting that the end of the piston is positioned at said detent portion, and oil-pressure supply means are provided for supplying oil pressure to said pressure chamber on the basis of a detection signal from said detection means.

In the above-described structure, in accordance with the present invention, an electric contact constituted by the piston and the cam is used as the detection means.

With the above-described arrangement, the detent resistance can be reduced in the portion other than the detent position, and therefore, the operability can be improved, and the proportion of the detent resistance occupied by the entire operating reaction can be reduced, that is, the proportion occupied by the load reaction can be increased to positively transmit the load reaction to the driver.

In addition, as the detection means, an electric contact constituted by the piston and the cam is used, whereby the mounting adjustment of the detection means need not be required, and therefore introduction work becomes easy. Furthermore, since influence due to the vibration of a machine body is hardly received, the reliability of the detecting operation is improved.

These and other objects will become apparent from the following detailed description taken in connection with the accompanying drawings.

BRIEF DESCRIPTION OF THE ACCOMPANYING DRAWINGS

FIG. 1 is a view showing a first embodiment according to the present invention;

FIGS. 2(*a*) and 2(*b*) are circuit views showing two examples of a drive circuit for a solenoid of an electromagnetic switching valve in the device shown in FIG. 1;

DETAILED DESCRIPTION OF THE PREFERRED EMBODIMENTS

Embodiments of the present invention will be described hereinafter in connection with FIGS. 1 to 5.

Figure 1:
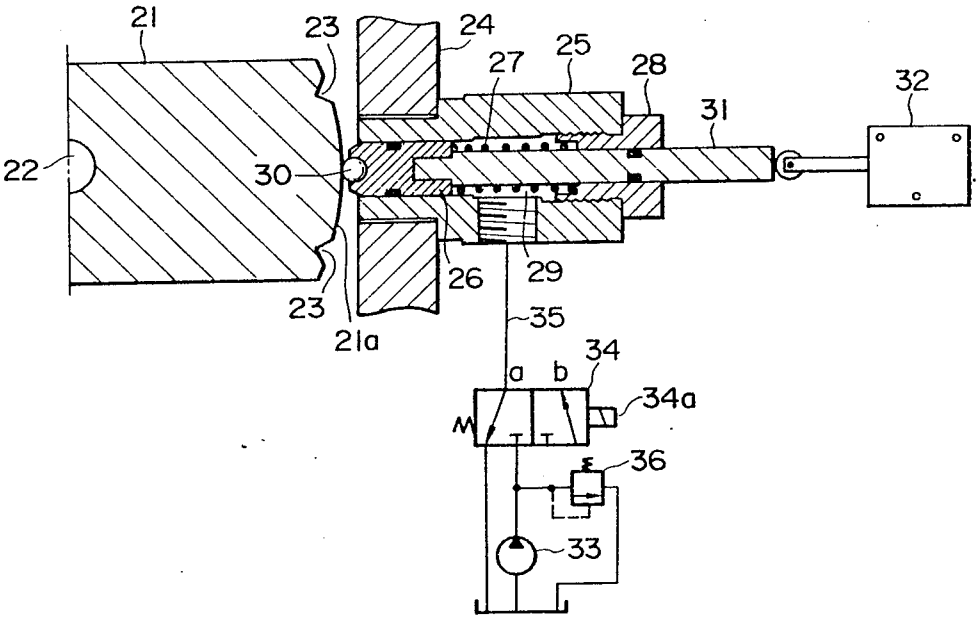
Figure 2A:
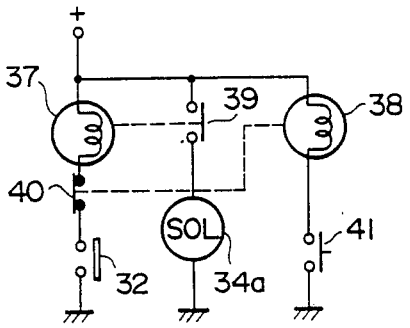
Figure 2B:
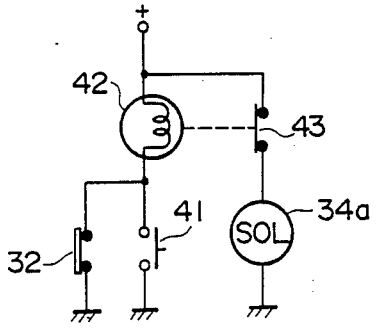
Figure 3:
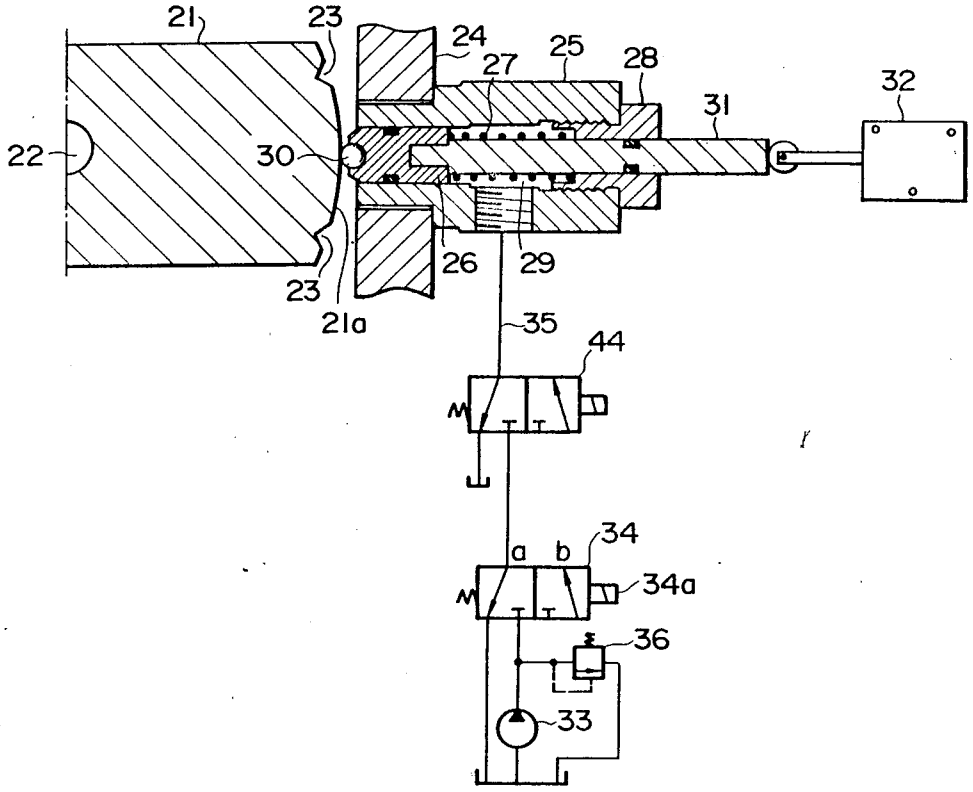
FIG. 3 is a view showing a second embodiment according to the present invention.
Figure 4:
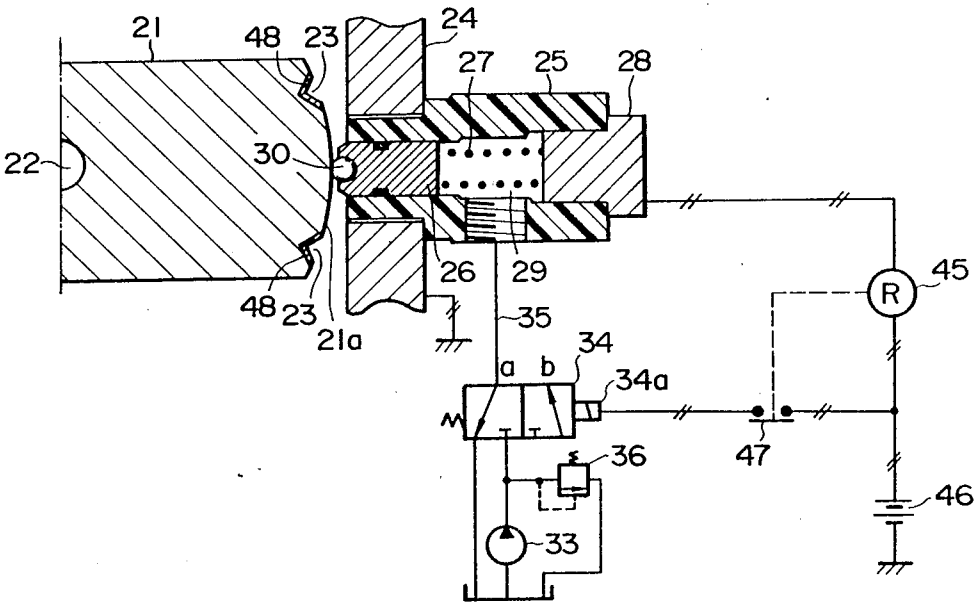
FIG. 4 is a view showing a third embodiment according to the present invention.
Figure 5:
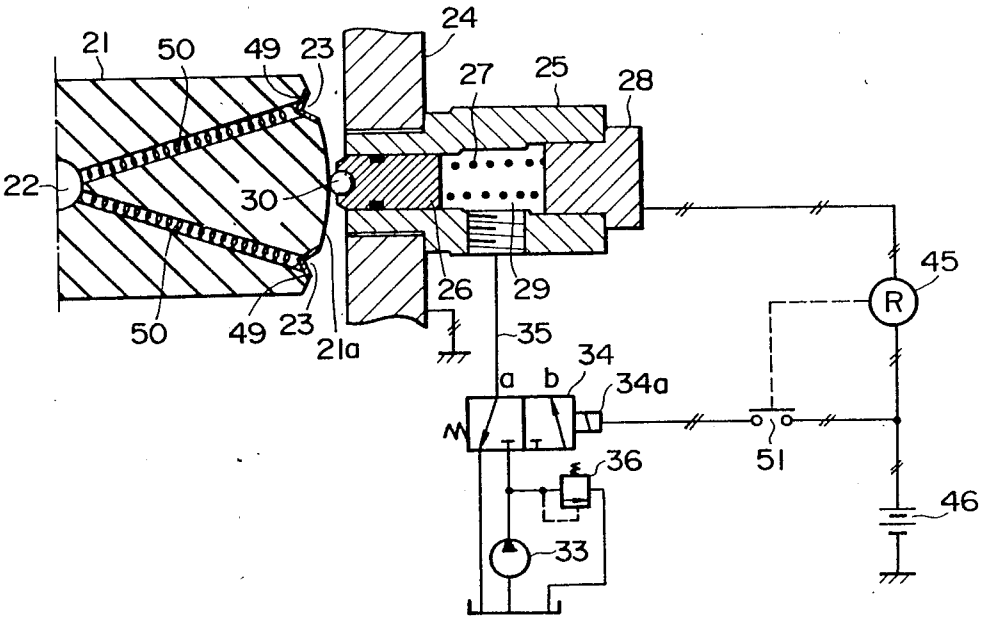
FIG. 5 is a view corresponding to FIG. 1 showing a fourth embodiment of the present invention.

FIGS. 1 and 2 show a first embodiment of the present invention, FIG. 3 shows a second embodiment, FIG. 4 shows a third embodiment, and FIG. 5 shows a fourth embodiment.

In these embodiments, a control lever for a winch controlling remote control valve, similarly to the above-described prior art.

FIRST EMBODIMENT (SEE FIGS. 1 AND 2)

Figure 6:
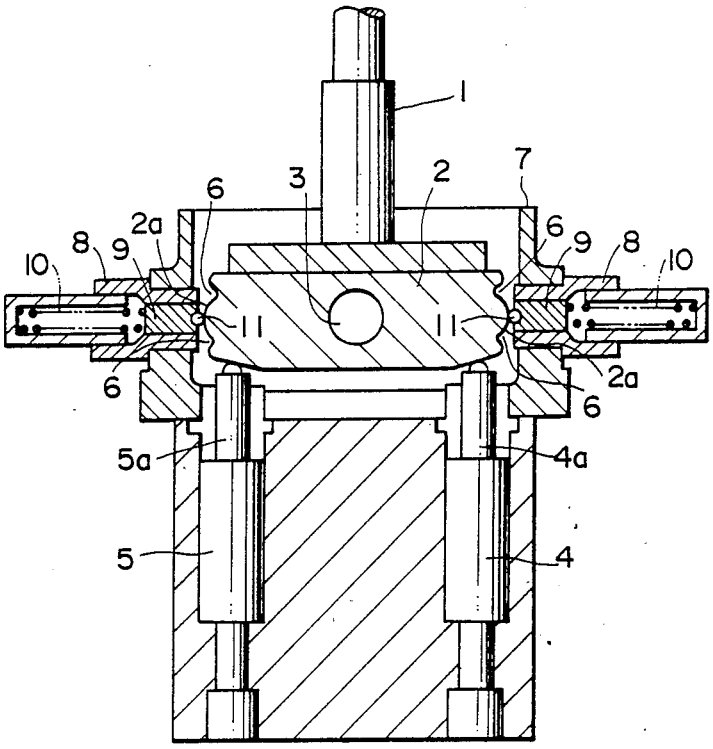
FIG. 6 PRIOR ART
FIG. 6 is a view showing a prior art.

Since the basic structure of the remote control valve in which the pilot reducing valve is actuated by the operation of the control lever is the same as that of the prior art shown in FIG. 6, the illustration of the control lever and the reducing valve is omitted and only the detent device portion is shown. Also, since the structure of the detent device is exactly the same in its both sides of the cam, only one side thereof is shown.

The reference numeral 21 designates a cam which is rotated around a horizontal shaft 22 integral with a control lever identical to control lever 1 of FIG. 6 by operation of the control lever. Recesses 23, 23 as detent portions are provided at upper and lower locations corresponding to operating positions (detent positions) on both sides of the lever in the side (hereinafter referred to the detent position) 21*a* of the cam 21. On the other hand, a piston case 25 is mounted on a housing 24 housing therein the cam 21, the piston case 25 being interiorly provided with a piston 26 and a push spring 27 for biasing the piston 26 toward the cam surface 21*a*. The reference numeral 28 designates a combination spring receive-cap mounted on the rear end of the piston case 25, and a pressure chamber 29 is formed between the cap 28 and the piston 26 within the piston case 25.

A ball 30 is held on the end of the piston 26, the ball 30 being elastically placed in contact with the cam surface 21*a* by the force of the push spring 27 and placed in engagement with the recess 23 at the detent position. In this case, the force of the push spring 27 has the minimum magnitude as required such that the contact state between the ball 30 and the cam surface 21*a* is secured through the entire lever stroke and is set to be so weak that the cam 21 (control lever) cannot be held by itself in the state wherein the ball 30 is engaged with the recess 23.

On the other hand, a rod 31 is integrally connected to the rear end of the piston 26 in the state wherein the rod 31 extends through the cap 28. A limit switch 32 is operated by the rod 31.

A hydraulic pump indicated at 33 is connected to the pressure chamber 29 within the piston case 25 through an electromagnetic switching valve 34 and a pipe 35. In the state wherein a solenoid 34*a* is not energized, the electromagnetic switching valve 34 is at a tank communication position a on the left side in the figure, and when the limit switch 32 is actuated, the solenoid 34*a* is energized and switched to a pressure oil supply position b on the right side in the figure. In this state, pressure oil is supplied from the pump 33 to the pressure chamber 29 whereby oil pressure acts on the pressure chamber 29.

In the detent position in which the ball 30 engages the recess 23, the force of the push spring 27 and the oil pressure of the pressure chamber 29 are applied to the piston 26 and these forces are applied to the ball 30 whereby the cam 21 (control lever) is held at the detent position. That is, only at the detent position, a great force that may overcome the reaction of the reducing valve to secure the detent function acts on the control lever, and during other operations of the lever, only a spring force which is so small that the contact state between the ball 30 and the cam surface 21*a* is secured so acts. Therefore, as compared with the conventional device in which a fixed great force always acts as the detent resistance, there is no unpleasant feeling during the operation of the lever and the operating reaction as a whole is small. Therefore, the operability is good.

In the case of the system in which the operating reaction according to the load is applied to the control lever, the detent resistance becomes small whereby the proportion of the load reaction occupied by the whole operating reaction becomes large. Therefore, the load reaction can be positively transmitted to the driver. In FIG. 1, the reference numeral 36 designates a relief valve for setting pressure of the pressure chamber 29. The detent is released by cutting off the energization of the electromagnetic switching valve 34 to the solenoid 34*a* through the operation of the release switch separately provided. Two examples of the circuit structure of the solenoid drive circuit are shown in FIGS. 2(*a*) and 2(*b*).

In the circuit shown in FIG. 2(*a*), a first relay 37 and a second relay 38 are used. A normally open contact 39 of the first relay 37 and the solenoid 34*a*, the first relay 37 and a normally closed contact 40 of the second relay 38 and the limit switch 32, and the second relay 38 and a release switch 41 are respectively connected in series, these three series circuits being connected in parallel between power sources.

In this circuit structure, when at the detent position, the limit switch is turned on, the first relay 37 is actuated to energize the solenoid 34*a*, and the electromagnetic valve 34 is switched to the pressure oil supply position b and is actuated. Thereafter, when the release switch 41 is turned on, the second relay 38 is actuated with the result that the normally closed contact 40 is opened and the first relay 37 is returned. Then, the normally open contact 39 is opened so that the energizing circuit of the solenoid 34*a* is cut off.

On the other hand, in the circuit shown in FIG. 2(*b*), a normally closed switch is used as the limit switch 32. The limit switch 32 is connected parallel with the release switch 41, and this parallel circuit is connected in series with the relay 42. A normally closed contact 43 of the relay 42 and the solenoid 34*a* are connected in series between power sources.

Since in this circuit, the limit switch 32 is a normally closed switch, the relay 42 is in the operating state at a position other than the detent position, and the normally closed contact 43 thereof is opened so that the solenoid 34*a* is disconnected. The limit switch 32 is then turned off by movement of the rod 31 in FIG. 1 at the detent position, and the relay 42 is returned and the normally closed contact 43 is closed to form an energizing circuit of the solenoid 34*a*. When the release switch 41 is turned on, the energization of the solenoid 34*a* is cut off.

Among the aforesaid two circuits, the FIG. 2(*b*) structure is simple. On the other hand, while the structure (*a*) is somewhat complicated, at the time of failure such as breaking of the wire to the relays 37 and 38, the detent function is merely eliminated. There is no inconvenience such that the detent function remaining effective, and a fail-safe function results.

SECOND EMBODIMENT (SEE FIG. 3)

In the case where the detent function is not necessary, e.g., where the lever is frequently operated, the release switch 41 in FIG. 2 must be operated for every lever operation.

In view of the above, in the second embodiment, an electromagnetic switching valve 44 is provided in a pipe 35 connecting the electromagnetic switching valve 34 and the pressure chamber 29, the electromagnetic switching valve 44 being controlled by a selection switch not shown. In this manner, if the electromagnetic switching valve 44 is set to the tank communication position in the figure when the detent function is not needed, the detent function can be eliminated at all times. Therefore, it is possible to save the trouble of operating the release switch 41 for every lever operation.

It is noted that as a sensor for detecting the fact that the ball 30 has engaged with the recess 23 by movement of the piston 26, a proximity switch or a photo sensor may be used in place of the limit switch 32.

THIRD EMBODIMENT (SEE FIG. 4) AND FOURTH EMBODIMENT (SEE FIG. 5)

In the case of the structure in which the ball 30 is engaged with the recess 23 to hold the control lever at the detent position, the amount of movement of the ball 30, that is, the stroke of movement of the piston 26 is normally as small as 0.5 mm to 1 mm. Therefore, in the case of the structure of the aforementioned first and second embodiments in which the engagement of the ball 30 with the recess 23 has to be detected by a small stroke variation of the piston 26, mounting adjustment of the sensor (limit switch 32 or proximity switch or photo sensor) becomes cumbersome. In addition, there possibly occurs a deviation in adjustment due to the vibration of the body during operation.

As a countermeasure, the recess 23 may be deepened to increase the stroke of the piston 26. However, in this case the force required to disengage the ball 30 from the recess 23, that is, the detent releasing force, increases and therefore the operability becomes deteriorated.

In view of the above, in the third and fourth embodiments, the movement of the piston 26 is not detected but an electric contact is constituted by the piston 26 and the cam 21 so that the engagement and disengagement between the ball 30 and the recess 23 are directly detected by opening and closing the contact.

That is, in the third embodiment, the piston case 25 is formed of ceramic such as aluminum oxide or rubber or other electric insulating material and other constituent members are formed of electrically conductive material to thereby constitute a series circuit of the cap 28 of the piston case 25—push spring 27—piston 26—ball 30—cam 21—horizontal shaft 22 as a fulcrum of cam housing 24 on which the horizontal shaft 22 is mounted (the body being grounded).

This series circuit is connected to a power source (battery) 46 through a relay 45, and a normally closed contact 47 of the relay 45 is inserted into an energizing circuit of the electromagnetic switching valve 34 to the solenoid 34*a*.

An insulating layer 48 formed of electric insulating material similar to the piston case 25 is provided on the surface in contact with the ball 30 of the recess 23.

In this manner, when the ball 30 is engaged with the recess 23, the piston 26 is disconnected from the cam 21 (contact is off), and in the state other than the justmentioned state, the energizing state (contact is on) is obtained.

In the case of the third and fourth embodiments, the rod 31 in the first and second embodiments is not needed.

In the contact-on state, the relay 45 is energized and actuated, and the normally closed contact 47 is opened. Therefore, the energizing circuit of the solenoid 34*a* is cut off. Accordingly, since the electromagnetic switching valve 34 is in the tank communication position a, oil pressure is not supplied to the pressure chamber 29.

When the ball 30 is engaged with the recess 23 at the detent position to assume the aforesaid contact-off state, the relay 45 is deenergized and the normally closed contact 47 is closed. Therefore, the electromagnetic switching valve 34 is switched to the pressure oil supply position b so that oil pressure is supplied to the pressure chamber 29.

On the other hand, in the fourth embodiment (FIG. 5), the structure is reversed as compared to that of the third embodiment. There, the cam 21 in addition to the piston case 25 is formed of electric insulating material, an electric conductive layer 49 formed of an electric conductive material is provided on the contact surface of the recess 23 with the ball 30, and the electric conductive layer 49 and the horizontal shaft 22 are connected by a lead wire 50 disposed within the cam 21.

A normally open contact 51 of the relay 45 is inserted into an energizing circuit of the electromagnetic switching valve 34 to the solenoid 34*a*.

Accordingly, in the case of the fourth embodiment, when the ball 30 is engaged with the recess 23 at the detent position, the contact-on state is formed and the relay 45 is actuated so that the solenoid 34 is energized to supply oil pressure to the pressure chamber 29.

As described above, the third and fourth embodiments have the structure wherein the electric contact is constituted by the piston 26 and the cam 21 and the electromagnetic switching valve 34 is controlled by opening and closing the contact. Therefore, cumbersome adjustment such as mounting adjustment of the sensor as in the case of the first and second embodiments in which the movement of the piston 26 is detected by the sensor is not needed. There is no problem of a deviation of adjustment due to the vibration of the body, and the reliability of detection is improved.

While in the above-described embodiments the recess 23 as a detent portion is provided on the side of the cam 21, and the ball 30 is provided on the side of the piston 26 opposed to the former, it is noted that, conversely thereto, a ball or a ball-like projection as a detent portion may be provided on the cam side, and a recess with which the projection is engaged may be provided on the piston side.

Furthermore, in the case where the electric contact constituted by the piston and the cam is used as detection means, the electric contact is not always constituted by the projection and the recess as in the above-described third and fourth embodiments. For example, there may instead be provided as a detent portion on the cam side, a stopper which comes into abutment with the piston to impede further rotation of the cam or a roughened portion for causing the frictional contact resistance of the piston to increase may be provided.

As described above, according to the present invention, at the detent position of the control lever, oil pressure is supplied to the pressure chamber formed at the rear of the piston to exhibit the detent function. Therefore, the detent resistance at a portion other than the detent position can be minimized. Because of this, the operability can be improved. In addition, in the case where the operating reaction according to the load is applied to the control lever, the proportion of the detent resistance occupied by the entire operating reaction can be made small, that is, the proportion for which the load reaction is occupied can be made large to positively transmit the load reaction to the driver.

Moreover, according to the structure in which the control lever having reached the detent position is detected by the electric contact constituted by the piston and the cam, the mounting adjustment of the detection means need not be required as compared with the case where the control lever having reached the detent position is detected by the movement of the piston, and therefore assembly becomes easy. Since the influence due to the vibration of the body hardly affects performance, the reliability of the detecting operation is improved.

What is claimed is:

1. A detent device connected to a control lever, comprising:

a cam integrally movable with the control lever, a piston mounted for sliding contact with a surface of the cam during movement of said cam, a pressure chamber communicating with a portion of said piston opposite said sliding contact, a spring provided within said pressure chamber and comprising means to bias said piston toward said cam, wherein said cam is provided with a detent portion in a part of said surface, and wherein the sliding resistance of the end of the piston is greater at the detent position of the control lever than at other portions of said surface, detection means for detecting that the end of the piston is positioned at said detent portion, and oil-pressure supply means responsive to the detection by said detection means of the end of said piston being positioned at said detent portion for supplying oil pressure to said chamber and so increasing a force pressing said piston toward said cam only when said detection means detects that the end of said piston is positioned at said detent portion.

2. A detent device according to claim 1, wherein the detection means comprises an electric contact including said piston and said cam.

3. A detent device according to claim 1, wherein said oil pressure supply means includes a first electromagnetic switching valve, a pipe connecting said first electromagnetic switching valve and said pressure chamber and a selection switch for controlling said first electromagnetic switching valve, further including a second electromagnetic switching valve in said pipe.

4. A detent device according to claim 1, including a piston case formed of electric insulating material, wherein said cam and said piston and said spring are formed of an electric conductive material.

5. A detent device according to claim 1 wherein said end of said piston comprises a ball and wherein said detection means comprises:

a rod connected to said piston, and switch means for sensing movement of said rod.

6. A detent device according to claim 5, wherein said switch means comprises a proximity switch.

* * * * *

UNITED STATES PATENT AND TRADEMARK OFFICE

CERTIFICATE OF CORRECTION

PATENT NO. : 4,922,784

DATED : MAY 8, 1990

INVENTOR(S) : SACHIO HIDAKA ET AL.

It is certified that error appears in the above-identified patent and that said Letters Patent is hereby corrected as shown below:

On the title page, delete "5 Drawing Sheets" and insert --6 Drawing Sheets--.

Signed and Sealed this

Twenty-seventh Day of August, 1991

*Attest:*

HARRY F. MANBECK, JR.

*Attesting Officer*

*Commissioner of Patents and Trademarks*